US010487379B2

(12) United States Patent
Okonogi et al.

(10) Patent No.: US 10,487,379 B2
(45) Date of Patent: Nov. 26, 2019

(54) HIGH-CARBON STEEL WIRE ROD WITH EXCELLENT WIRE DRAWABILITY

(71) Applicant: NIPPON STEEL & SUMITOMO METAL CORPORATION, Tokyo (JP)

(72) Inventors: Makoto Okonogi, Tokyo (JP); Daisuke Hirakami, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 312 days.

(21) Appl. No.: 15/329,455

(22) PCT Filed: Aug. 3, 2015

(86) PCT No.: PCT/JP2015/071969
§ 371 (c)(1),
(2) Date: Jan. 26, 2017

(87) PCT Pub. No.: WO2016/021556
PCT Pub. Date: Feb. 11, 2016

(65) Prior Publication Data

US 2017/0321309 A1 Nov. 9, 2017

(30) Foreign Application Priority Data

Aug. 8, 2014 (JP) ..... 2014-162373

(51) Int. Cl.

| | |
|---|---|
| ***C21D 8/06*** | (2006.01) |
| ***C22C 38/00*** | (2006.01) |
| ***C22C 38/02*** | (2006.01) |
| ***C22C 38/04*** | (2006.01) |
| ***C22C 38/54*** | (2006.01) |

(52) U.S. Cl.
CPC ..... *C22C 38/04* (2013.01); *C21D 8/065* (2013.01); *C22C 38/00* (2013.01); *C22C 38/001* (2013.01); *C22C 38/02* (2013.01); *C22C 38/54* (2013.01); *C21D 8/06* (2013.01); *C21D 2211/009* (2013.01)

(58) Field of Classification Search
None
See application file for complete search history.

(56) References Cited

U.S. PATENT DOCUMENTS

| | | | | |
|---|---|---|---|---|
| 7,850,793 | B2 * | 12/2010 | Nagao | C21D 8/06 148/320 |
| 2006/0048864 | A1 | 3/2006 | Nagao et al. | |
| 2009/0087336 | A1 * | 4/2009 | Nishida | C21D 8/065 420/91 |
| 2010/0212786 | A1 | 8/2010 | Yamasaki et al. | |
| 2013/0127100 | A1 | 5/2013 | Ishida et al. | |

FOREIGN PATENT DOCUMENTS

| | | | | |
|---|---|---|---|---|
| CN | 1685072 | A | 10/2005 | |
| CN | 101341270 | A | 1/2009 | |
| EP | 2025769 | A1 | 2/2009 | |
| EP | 2053094 | A1 | 7/2009 | |
| JP | 55-062143 | * | 5/1980 | C22C 38/00 |
| JP | 5-295448 | A | 11/1993 | |
| JP | 6-200352 | A | 7/1994 | |
| JP | 2000-119805 | A | 4/2000 | |
| JP | 2003-82434 | A | 3/2003 | |
| JP | 2004-137597 | A | 5/2004 | |
| JP | 2005-206853 | A | 8/2005 | |
| JP | 2006-200039 | A | 8/2006 | |
| JP | 2007-131944 | A | 5/2007 | |
| JP | 2012-72492 | A | 4/2012 | |
| JP | 2012-126954 | A | 7/2012 | |
| JP | 2012-126955 | A | 7/2012 | |
| KR | 10-2008-0017433 | A | 2/2008 | |
| WO | WO 2007/139234 | A1 | 12/2007 | |
| WO | WO 2008/044356 | A1 | 4/2008 | |
| WO | WO 2010/066708 | A1 | 6/2010 | |

OTHER PUBLICATIONS

Machine-English translation of JP 2000-119805, Ofuji Yoshihiro et al., Sep. 24, 1998.*
Machine-English translation of JP 55-062143, Suzuki Shinichi et al., , May 10, 1980.*
International Search Report for PCT/JP2015/071969 dated Oct. 20, 2015.
Written Opinion of the International Searching Authority for PCT/JP2015/071969 (PCT/ISA/237) dated Oct. 20, 2015.
Korean Office Action, dated Jun. 5, 2018, for corresponding Korean Application No. 10-2017-7002972, with a partial English Translation.
Chinese Office Action and Search Report issued in Chinese Application No. 201580042546.6 dated Nov. 15, 2017, together with an English translation of the Office Action.
Chinese Office Action, dated Sep. 17, 2018, for corresponding Chinese Application No. 201580042546.6, with a partial English translation.
Extended European Search Report dated Feb. 22, 2018 for corresponding European Application No. 15830061.6.
European Office Action, dated Feb. 13, 2019, for corresponding European Application No. 15830061.6.

* cited by examiner

*Primary Examiner* — Colin W. Slifka
(74) *Attorney, Agent, or Firm* — Birch, Stewart, Kolasch & Birch, LLP

(57) ABSTRACT

Provided is a high-carbon steel wire rod with excellent wire drawability, containing predetermined chemical components and the balance: Fe and impurities. In a cross-section perpendicular to a longitudinal direction, an area fraction of pearlite is equal to or more than 95% and equal to or less than 100%, an average block size of the pearlite is 10 μm to 30 μm and standard deviation of block size is 20 μm or less, and when Ceq.=C (%)+Si (%)/24+Mn (%)/6, a tensile strength is equal to or more than 760×Ceq.+255 MPa and equal to or less than 760×Ceq.+325 MPa, reduction of area in a tensile test is −65×Ceq.+96(%) or more, and standard deviation of the reduction of area is 6% or less.

2 Claims, No Drawings

HIGH-CARBON STEEL WIRE ROD WITH EXCELLENT WIRE DRAWABILITY

TECHNICAL FIELD

The present invention relates to a high-carbon steel wire rod with excellent wire drawability, suitable for uses such as steel cord used as a reinforcing member in a radial tire of an automobile or various kinds of belts and hose for industry, and sawing wire.

BACKGROUND ART

Steel wire for steel cord used as a reinforcing member in a radial tire of an automobile or various kinds of belts and hose, or steel wire for sawing wire generally uses, as a material, a wire rod with a wire diameter, i.e., diameter, of 4 to 6 mm that has undergone adjusted cooling after hot rolling. This wire rod undergoes primary wire drawing to be steel wire with a diameter of 3 to 4 mm. Then, the steel wire is subjected to intermediate patenting treatment and further undergoes secondary wire drawing to have a diameter of 1 to 2 mm. After that, the steel wire is subjected to final patenting treatment and then to brass plating. Then, the steel wire undergoes final wet wire drawing to be steel wire with a diameter of 0.15 to 0.40 mm. High-carbon steel wire obtained in this manner is further subjected to twisting in a manner that a plurality of high-carbon steel wires are twisted together to form a twisted steel wire; thus, steel cord is produced.

In recent years, for a reduction in production cost of steel wire, intermediate patenting mentioned above is omitted and wire drawing is performed directly from a wire rod that has undergone adjusted cooling into 1 to 2 mm, which is a wire diameter after final patenting treatment, in more and more cases. This requires the wire rod that has undergone adjusted cooling to have direct wire drawing characteristics from a wire rod, i.e., so-called rod drawability, and high ductility and high workability of a wire rod are required increasingly strongly.

For example, as described in Patent Literatures 1 to 7, many suggestions have been made for a technique of improving wire drawability of a wire rod that has undergone patenting treatment. For example, Patent Literature 1 discloses a high-carbon wire rod in which a pearlite structure has an area fraction of 95% or more, and the average nodule diameter and the average lamellar spacing in the pearlite structure are 30 μm or less and 100 nm or more, respectively. Moreover, Patent Literature 4 discloses a high-strength wire rod containing B. These conventional technologies, however, cannot reduce wire-breaks that accompany an increase in wire drawing speed and an increase in wire drawing working ratio, or provide an effect of improving wire drawability enough to influence working cost in wire drawing.

CITATION LIST

Patent Literature

Patent Literature 1: JP 2003-082434A
Patent Literature 2: JP 2005-206853A
Patent Literature 3: JP 2006-200039A
Patent Literature 4: JP 2007-131944A
Patent Literature 5: JP 2012-126954A
Patent Literature 6: WO2008/044356
Patent Literature 7: JP 2004-137597A

SUMMARY OF INVENTION

Technical Problem

The present invention, in view of the current state of conventional technologies, aims to provide a high-carbon steel wire rod with excellent wire drawability, suitable for uses such as steel cord and sawing wire, inexpensively with high productivity and good yield.

Solution to Problem

To improve wire drawability of a high-carbon steel wire rod, it is effective to reduce tensile strength of the wire rod and to improve ductility of the wire rod by grain refining of pearlite blocks of a pearlite structure. Normally, tensile strength and ductility of a high-carbon steel wire rod whose main constituent is a pearlite structure depend on pearlite transformation temperature. In the pearlite structure, cementite and ferrite are arranged in a layered structure, and lamellar spacing between the layers greatly influences tensile strength. Moreover, the lamellar spacing of the pearlite structure is determined by transformation temperature in transformation from austenite to pearlite. When the pearlite transformation temperature is high, the pearlite structure has large lamellar spacing and the wire rod has low tensile strength. When the pearlite transformation temperature is low, the pearlite structure has small lamellar spacing and the wire rod has high tensile strength.

In addition, ductility of the wire rod is influenced by size of pearlite blocks in the pearlite structure (pearlite block size). This pearlite block size is also influenced by pearlite transformation temperature, like the lamellar spacing. For example, when the pearlite transformation temperature is high, the pearlite block size is large and ductility is low. When the pearlite transformation temperature is low, the pearlite block is small and ductility is improved.

That is, when the pearlite transformation temperature is high, the wire rod has low tensile strength and ductility. When the pearlite transformation temperature is low, the wire rod has high tensile strength and ductility. To improve wire drawability of a wire rod, it is effective to reduce tensile strength of the wire rod and increase ductility of the wire rod. However, as described above, it has been difficult to satisfy both the tensile strength and ductility of the wire rod, both when the transformation temperature is high and when the transformation temperature is low.

To solve the above-described problem, the present inventors carried out detailed studies about the influence of the structure and mechanical characteristics of a wire rod on wire drawability, and consequently reached the following findings. Hereinafter, a region from the surface of the wire rod to a depth of 50 μm or less toward the center will be called a surface layer part.

(a) To reduce frequency of wire-breaks, it is effective to set the average block size of pearlite blocks in a cross-section of the wire rod to 10 μm to 30 μm. In addition, if standard deviation of block size exceeds 20 μm, exhibiting great variation in size, the frequency of wire-breaks becomes high.

(b) To improve wire drawability of a wire rod, it is effective to set the tensile strength of the wire rod to equal to or more than 760×Ceq.+255 MPa and equal to or less than 760×Ceq.+325 MPa.

(c) To improve wire drawability of a wire rod, it is effective to set reduction of area in a tensile test of the wire rod to −65×Ceq.+96(%) or more.

(d) To improve wire drawability of a wire rod, it is effective to reduce variation in reduction of area in a tensile test of the wire rod. In particular, setting standard deviation of reduction of area of the wire rod to 6% or less reduces the frequency of wire-breaks.

The present invention has been made based on the above findings, and its summary is as follows.

[1]

A high-carbon steel wire rod according to the present invention contains chemical components of, in mass %, C: 0.70% to 1.20%, Si: 0.10% to 1.2%, Mn: 0.10% to 1.0%, P: 0.001% to 0.012%, S: 0.001% to 0.010%, N: 0.001% to 0.005%, and the balance: Fe and impurities. In a cross-section perpendicular to a longitudinal direction, an area fraction of pearlite is equal to or more than 95% and equal to or less than 100%, an average block size of the pearlite is 10 μm to 30 μm and standard deviation of block size is 20 μm or less, and when Ceq. is obtained using formula (1) below, a tensile strength is equal to or more than 760×Ceq.+255 MPa and equal to or less than 760×Ceq.+325 MPa, reduction of area in a tensile test is −65×Ceq.+96(%) or more, and standard deviation of the reduction of area is 6% or less, $$Ceq.=C(\%)+Si(\%)/24+Mn(\%)/6 \quad \text{formula(1)},$$

where C (%), Si (%), and Mn (%) represent contents in mass % of C, S, and Mn, respectively.

[2]

The high-carbon wire rod according to [1] may further contain chemical components of, in mass %, one or two or more selected from the group consisting of Al: 0.0001% to 0.010%, Ti: 0.001% to 0.010%, B: 0.0001% to 0.0015%, Cr: 0.05% to 0.50%, Ni: 0.05% to 0.50%, V: 0.01% to 0.20%, Cu: 0.05% to 0.20%, Mo: 0.05% to 0.20%, Nb: 0.01% to 0.10%, Ca: 0.0005% to 0.0050%, Mg: 0.0005% to 0.0050%, and Zr: 0.0005% to 0.010%.

Advantageous Effects of Invention

According to the modes of [1] and [2] described above, a high-carbon steel wire rod with excellent wire drawability can be provided inexpensively.

DESCRIPTION OF EMBODIMENTS

First, description will be given on reasons for limiting chemical components of a high-carbon steel wire rod in the present embodiment. In the following description, "%" means mass %.

C: 0.70% to 1.20%

C is an element necessary for enhancing the strength of a wire rod. A C content less than 0.70% makes it difficult to stably impart strength to a final product, and also promotes precipitation of pro-eutectoid ferrite at the austenite grain boundary, which makes it difficult to obtain a uniform pearlite structure. Hence, the lower limit of the C content is set to 0.70%. To obtain a more uniform pearlite structure, the C content is preferably 0.80% or more. On the other hand, a C content exceeding 1.20% causes net-like pro-eutectoid cementite to be generated at the austenite grain boundary, making wire-breaks likely to occur in wire drawing, and also causes toughness and ductility of high-carbon steel wire after final wire drawing to deteriorate significantly. Hence, the upper limit of the C content is set to 1.20%. To prevent the deterioration of toughness and ductility of the wire rod more surely, the C content is preferably 1.10% or less.

Si: 0.10% to 1.2%

Si is an element necessary for enhancing the strength of a wire rod. Furthermore, Si is an element useful as a deoxidizer, and is necessary also for a wire rod not containing Al. A Si content less than 0.10% makes the deoxidizing action too little. Hence, the lower limit of the Si content is set to 0.10%. On the other hand, if the Si content exceeds 1.2%, precipitation of pro-eutectoid ferrite is promoted in hyper-eutectoid steel. Furthermore, a limit working ratio in wire drawing is reduced. In addition, wire drawing by mechanical descaling, i.e., MD, becomes difficult. Hence, the upper limit of the Si content is set to 1.2%. To prevent the deterioration of wire drawability more surely, the Si content is preferably 0.8% or less.

Mn: 0.10% to 1.0%

Like Si, Mn is an element useful as a deoxidizer. In addition, Mn is effective in improving hardenability to enhance the strength of a wire rod. Furthermore, Mn has an effect of preventing hot embrittlement by fixing S in the steel as MnS. A Mn content less than 0.10% hardly provides this effect. Hence, the lower limit of the Mn content is set to 0.10%. On the other hand, Mn is an element that is easily segregated. A Mn content exceeding 1.0% particularly causes segregation of Mn at the center portion of the wire rod, and martensite and bainite are generated at the segregation portion, which reduces wire drawability. Hence, the upper limit of the Mn content is set to 1.0%. To prevent the deterioration of wire drawability more surely, the Mn content is preferably 0.7% or less.

P: 0.001% to 0.012%

P is an element that is segregated at a grain boundary to reduce toughness of a wire rod. A P content exceeding 0.012% causes ductility of the wire rod to deteriorate significantly. Hence, the upper limit of the P content is set to 0.012%. The lower limit of the P content is set to 0.001% in consideration of current refining technologies and production cost.

S: 0.001% to 0.010%

S forms sulfide MnS with Mn to prevent hot embrittlement. A S content exceeding 0.010% causes ductility of the wire rod to deteriorate significantly. Hence, the upper limit of the S content is set to 0.010%. The lower limit of the S content is set to 0.001% in consideration of current refining technologies and production cost.

N: 0.0010% to 0.0050%

N is an element that promotes aging during wire drawing as solid solution N to cause wire drawability to deteriorate. Hence, the upper limit of the N content is set to 0.0050%. The lower limit of the N content is set to 0.0010% in consideration of current refining technologies and production cost.

The above elements are the basic components of a high-carbon steel wire rod in the present embodiment, and the balance excluding the above elements is Fe and impurities. However, in addition to these basic components, a high-carbon steel wire rod in the present embodiment may contain, in place of part of Fe serving as the balance, one or two or more elements of Al, Ti, B, Cr, Ni, V, Cu, Mo, Nb, Ca, Mg, and Zr within ranges described below in order to obtain a deoxidation effect and improve mechanical characteristics of the wire rod, such as strength, toughness, and ductility.

Al: 0.0001% to 0.010%

Al functions as a deoxidizing element, and also generates hard, non-deforming alumina-based non-metallic inclusion, causing ductility of a wire rod to deteriorate. Hence, the upper limit of the Al content is set to 0.010%. The lower limit of the Al content is set to 0.0001% in consideration of current refining technologies and production cost.

Ti: 0.001% to 0.010%

Ti is an element that has a deoxidizing action. Moreover, Ti has an effect of forming nitride to suppress coarsening of austenite grains. Here, a Ti amount less than 0.001% does not sufficiently provide the aforementioned effect. On the other hand, a Ti amount exceeding 0.010% may cause a reduction in workability due to coarse carbonitride (e.g., TiCN).

B: 0.0001% to 0.0015%

When B is present in austenite in a solid solution state, B is concentrated at a grain boundary to suppress generation of non-pearlite precipitate, such as ferrite, degenerate-pearlite, and bainite, improving wire drawability. Hence, the B content is preferably 0.0001% or more. On the other hand, a B content exceeding 0.0015% leads to generation of coarse boron carbide such as $Fe_{23}(CB)_6$, causing deterioration of wire drawability of a wire rod. Hence, the upper limit of the B content is preferably set to 0.0015%.

Cr: 0.05% to 0.50%

Cr is an element that is effective in making the lamellar spacing of pearlite finer to improve the strength, wire drawability, and the like of a wire rod. A Cr content of 0.05% or more is preferable for effective exertion of such an action. On the other hand, a Cr content exceeding 0.50% lengthens time until the end of pearlite transformation, and may generate a supercooled structure, such as martensite or bainite, in the wire rod. Furthermore, mechanical descalability becomes worse. Hence, the upper limit of the Cr content is preferably set to 0.50%.

Ni: 0.05 to 0.50%

Ni is an element that does not contribute so much to an increase in strength of a wire rod, but enhances toughness of a high-carbon steel wire rod. A Ni content of 0.05% or more is preferable for effective exertion of such an action. On the other hand, a Ni content exceeding 0.50% lengthens time until the end of pearlite transformation. Hence, the upper limit of the Ni content is preferably set to 0.50%.

V: 0.01% to 0.20%

V forms fine carbonitride in ferrite to prevent coarsening of austenite grains in heating, improving ductility of a wire rod. V also contributes to an increase in strength after hot rolling. A V content of 0.01% or more is preferable for effective exertion of such an action. However, a V content exceeding 0.20% makes the amount of formation of carbonitride excessively large and also increases grain size of carbonitride. Hence, the upper limit of the V content is preferably set to 0.20%.

Cu: 0.05% to 0.20%

Cu has an effect of enhancing corrosion resistance of high-carbon steel wire. A Cu content of 0.05% or more is preferable for effective exertion of such an action. However, if the Cu content exceeds 0.20%, Cu reacts with S and CuS is segregated in a grain boundary; thus, in a production process of a wire rod, flaws occur in a steel ingot, a wire rod, or the like. To prevent such an adverse effect, the upper limit of the Cu content is preferably set to 0.20%.

Mo: 0.05% to 0.20%

Mo has an effect of enhancing corrosion resistance of high-carbon steel wire. A Mo content of 0.05% or more is preferable for effective exertion of such an action. On the other hand, a Mo content exceeding 0.20% lengthens time until the end of pearlite transformation. Hence, the upper limit of the Mo content is preferably set to 0.20%.

Nb: 0.01% to 0.10%

Nb has an effect of enhancing corrosion resistance of high-carbon steel wire. A Nb content of 0.01% or more is preferable for effective exertion of such an action. On the other hand, a Nb content exceeding 0.10% lengthens time until the end of pearlite transformation. Hence, the upper limit of the Nb content is preferably set to 0.10%.

Ca: 0.0005% to 0.0050%

Ca is an element that reduces hard alumina-based inclusion. Moreover, Ca is generated as fine oxide. Consequently, pearlite block size of a steel wire rod becomes finer and the ductility of the steel wire rod is improved. To obtain these effects, the Ca content is preferably 0.0005% to 0.0050%, further preferably 0.0005% to 0.0040%. A Ca content exceeding 0.0050% causes coarse oxide to be formed, which may cause breaks in wire drawing.

Mg: 0.0005% to 0.0050%

Mg is generated as fine oxide. Consequently, pearlite block size of a steel wire rod becomes finer and the ductility of the steel wire rod is improved. To obtain this effect, the Mg content is preferably 0.0005% to 0.0050%, further preferably 0.0005% to 0.0040%. A Mg content exceeding 0.0050% causes coarse oxide to be formed, which may cause breaks in wire drawing.

Zr: 0.0005% to 0.010%

Zr crystallizes out as ZrO to serve as the crystallization nucleus of austenite, and thus enhances an equiaxed crystal ratio of austenite and makes austenite grains finer. Consequently, pearlite block size of a steel wire rod becomes finer and the ductility of the steel wire rod is improved. To obtain this effect, the Zr content is preferably 0.0005% to 0.010%, further preferably 0.0005% to 0.0050%. A Zr content exceeding 0.010% causes coarse oxide to be formed, which may cause breaks in wire drawing.

Next, description will be given on the structure and mechanical characteristics of a high-carbon steel wire rod according to the present embodiment.

In a high-carbon steel wire rod according to the present embodiment whose main structure is a pearlite structure, if an area fraction of a non-pearlite structure, such as pro-eutectoid ferrite, bainite, degenerate-pearlite, and pro-eutectoid cementite, in a cross-section perpendicular to the longitudinal direction exceeds 5%, cracks are likely to occur in wire drawing and wire drawability deteriorates. Hence, an area fraction of the pearlite structure is set to 95% or more. The upper limit is set to 100% because a smaller amount of the non-pearlite structure leads to further suppression of occurrence of cracks.

A pearlite area fraction of a high-carbon steel wire rod according to the present embodiment indicates the average area fraction of area fractions of pearlite in a surface layer part, a ½D part, and a ¼D part, where D represents wire diameter.

The pearlite area fraction may be measured by the following method. That is, a C cross-section, i.e., a cross-section perpendicular to the longitudinal direction, of the high-carbon steel wire rod is embedded in resin and then subjected to alumina polishing and corroded with saturated picral, and subjected to SEM observation. Hereinafter, a range from the surface of the wire rod to 50 μm or less toward the center will be called a surface layer part. Regions observed by SEM observation are a surface layer part, a ¼D part, and a ½D part, where D represents wire diameter. Then, in each region, eight spots are photographed every 45° with 3000-fold magnification. Then, a degenerate-pearlite part where cementite is dispersed as grains, a bainite part where plate-shaped cementite is dispersed with coarse lamellar spacing of three times or more as compared with the surroundings, a pro-eutectoid ferrite part precipitated along a prior austenite grain boundary, and a pro-eutectoid cementite part, which are non-pearlite structures, are colored with different colors based on visual observation, and area fractions thereof are measured by image analysis. The sum of the measured area fractions of the non-pearlite structures is obtained as a non-pearlite area fraction. The area fraction of the pearlite structure is obtained by subtracting the non-pearlite area fraction from 100%.

A pearlite block is a region where crystal orientation of ferrite can be regarded as the same, and finer average block sizes further improve ductility of a wire rod. An average block size exceeding 30 μm reduces ductility of the wire rod, making wire-breaks likely to occur in wire drawing. On the other hand, an average block size less than 10 μm increases tensile strength and increases deformation resistance in wire drawing, leading to an increase in working cost. Moreover, if standard deviation of block size exceeds 20 μm, variation in block size increases and the frequency of wire-breaks increases in wire drawing. The block size indicates a diameter of a circle having the same area as an area occupied by a pearlite block.

The block size of a pearlite block is obtained by the following method. A C cross-section of the wire rod is embedded in resin and then subjected to cutting and polishing. Then, at the center portion of the C cross-section, a region of 500 μm×500 μm is analyzed by EBSD. A measurement step was set to 1 μm, and an interface with a misorientation of 9° or more in this region is regarded as an interface of a pearlite block. A region of five pixels or more surrounded by the interface, the region excluding the measurement boundary of 500 μm×500 μm, is analyzed as one pearlite block. The average value of equivalent circle diameters of the pearlite blocks is obtained as the average block size.

If a tensile strength of the wire rod exceeds 760×Ceq.+325 MPa, deformation resistance increases in wire drawing. This results in an increase in drawing power in wire drawing, which increases working cost. If a tensile strength of the wire rod is less than 760×Ceq.+255 MPa, a rate of wire-breaks increases, causing deterioration of wire drawability. If reduction of area in a tensile test of the wire rod is less than −65×Ceq.+96(%), a rate of wire-breaks increases, causing deterioration of wire drawability. Moreover, if standard deviation of reduction of area in a tensile test exceeds 6%, variation in reduction of area increases, causing deterioration of wire drawability. Ceq. is obtained using formula (1) below.

$$Ceq.=C(\%)+Si(\%)/24+Mn(\%)/6 \quad \text{formula(1)}$$

A tensile test for obtaining tensile strength and reduction of area of a wire rod is performed pursuant to JIS Z 2241. Sixteen consecutive #9B test pieces are taken from the longitudinal direction of the wire rod. Each test piece has a length of 400 mm and is taken so as to include at least two rings of the wire rod wound into rings. Using these test pieces, the average tensile strength and the average reduction of area are obtained.

Standard deviation of reduction of area in the tensile test is obtained from data on reduction of area of the sixteen test pieces.

Next, description will be given on a method for producing a high-carbon steel wire rod according to the present embodiment.

A production method is not particularly limited in the present embodiment, but for example, a high-carbon steel wire rod having features of the present embodiment can be produced by the following method.

In the present embodiment, a steel piece with the above-described chemical components is heated to 1000° C. to 1100° C. and subjected to hot rolling to be a wire rod, and the wire rod is wound at 800° C. to 900° C. After the winding, primary cooling of 3 seconds or more and 7 seconds or less is performed at a primary cooling rate of 40° C./second to 60° C./second to 600° C. to 630° C. To set the average block size of pearlite within the range of the present invention and set the average tensile strength within the range of the present invention, it is effective to control the primary cooling rate. After that, the wire rod is retained for 15 to 50 seconds in a temperature region of 630° C. to 600° C. To reduce standard deviation of pearlite block size, retention treatment in this temperature region is effective. After that, secondary cooling is performed to 300° C. or lower at a secondary cooling rate of 5° C./second to 30° C./second. In this case, the lower limit of the endpoint temperature of secondary cooling may be ordinary temperature (25° C.). A high-carbon steel wire rod according to the present embodiment can be produced by the above-described method. This production method eliminates the need for raising temperature again in a cooling process after wire rod rolling, making it possible to produce a high-carbon steel wire rod inexpensively.

EXAMPLES

Next, technical contents of the present invention will be described referring to Examples of the present invention. Note that conditions in Examples are only condition examples employed to assess the feasibility and effect of the present invention, and the present invention is not limited to these conditions. The present invention may employ various conditions to the extent that they do not depart from the spirit of the present invention and they achieve the object of the present invention.

Steel billets containing chemical components shown in Table 1 were each heated and then subjected to hot rolling to be a wire rod with a diameter of 5.5 mm. The wire rod was wound at a predetermined temperature and then was cooled by Stelmor equipment.

Using the wire rod after cooling, structure observation of a C cross-section of the wire rod and a tensile test were performed. With regard to wire drawability, ten wire rods with a length of 4 m were prepared in the following manner: scales of the wire rod were removed by pickling and then a zinc phosphate coating was provided by bonderizing treatment. Then, single-head wire drawing with reduction of area of 16% to 20% per pass was performed using a die with an approach angle of 10 degrees. Then, the average value of true strain at the wire drawing rupture limit was obtained.

Table 2 shows production conditions, structure, and mechanical characteristics. "Retention time" in Table 2 indicates retention time in a temperature region of 630° C. to 600° C. In Table 2, Example Nos. 1, 3, 5, 8, 10, 13, 15, and 20 did not satisfy the claims of the present invention. For Example No. 1, components, an area fraction of the pearlite structure, and tensile strength did not satisfy the range of the present invention. The strain at a wire-break was lower than those of Examples satisfying the range of the present invention. For Example No. 3, an area fraction of the pearlite structure, an average block size, tensile strength, and reduction of area did not satisfy the range of the present invention. The strain at a wire-break was lower than that of Example No. 2 satisfying the range of the present invention with the same components. For Example No. 5, an average block size, standard deviation of block size, and reduction of area did not satisfy the range of the present invention. The strain at a wire-break was lower than that of Example No. 4 satisfying the range of the present invention with the same components. For Example No. 8, an area fraction of the pearlite structure, and tensile strength were outside the range of the present invention, and the strain at a wire-break was lower than that of Example No. 7 satisfying the range of the present invention with the same components. For Example No. 10, standard deviation of block size, and standard deviation of reduction of area were outside the range of the present invention, and the strain at a wire-break was lower than that of Example No. 9 satisfying the range of the present invention with the same components. For Example No. 13, an average block size and reduction of area were outside the range of the present invention, and the strain at a wire-break was lower than that of Example No. 12 satisfying the range of the present invention with the same components. For Example No. 15, an average block size, standard deviation of block size, and reduction of area were outside the range of the present invention, and the strain at a wire-break was lower than that of Example No. 14 satisfying the range of the present invention with the same components. For Example No. 20, the amount of C exceeded the upper limit of the present invention, and the strain at a wire-break was lower than those of Examples satisfying the range of the present invention.

TABLE 1

| Steel | C | Si | Mn | P | S | N | Al | Ti | B | Cr | Ni |
|---|---|---|---|---|---|---|---|---|---|---|---|
| A | 0.61 | 0.21 | 0.75 | 0.007 | 0.008 | 0.0035 | 0.007 | | | | |
| B | 0.70 | 0.22 | 0.87 | 0.011 | 0.008 | 0.0042 | 0.002 | | | | 0.07 |
| C | 0.71 | 0.20 | 0.51 | 0.007 | 0.007 | 0.0038 | 0.001 | 0.003 | 0.0007 | 0.22 | |
| D | 0.72 | 0.19 | 0.49 | 0.008 | 0.009 | 0.0029 | 0.001 | | | | |
| E | 0.77 | 0.18 | 0.42 | 0.009 | 0.007 | 0.0026 | | 0.002 | | | |
| F | 0.81 | 0.19 | 0.51 | 0.006 | 0.008 | 0.0029 | | | | | |
| G | 0.82 | 1.08 | 0.49 | 0.009 | 0.008 | 0.0033 | 0.001 | | | | |
| H | 0.82 | 0.19 | 0.50 | 0.008 | 0.009 | 0.0019 | 0.002 | | 0.0006 | | 0.09 |
| I | 0.82 | 0.20 | 0.49 | 0.007 | 0.006 | 0.0031 | | | | | |
| J | 0.87 | 0.22 | 0.48 | 0.010 | 0.004 | 0.0028 | | | | | |
| K | 0.92 | 0.21 | 0.33 | 0.007 | 0.008 | 0.0034 | | | | 0.12 | |
| L | 0.98 | 0.18 | 0.49 | 0.008 | 0.009 | 0.0031 | 0.002 | | | 0.13 | |
| M | 1.12 | 0.20 | 0.31 | 0.005 | 0.008 | 0.0027 | | 0.002 | 0.0008 | | |
| N | 1.31 | 0.19 | 0.55 | 0.009 | 0.007 | 0.0031 | 0.003 | | | | |

| Steel | V | Cu | Mo | Nb | Ca | Mg | Zr | Remarks |
|---|---|---|---|---|---|---|---|---|
| A | | | | | | | | Comparative Example |
| B | | 0.06 | | | 0.0008 | 0.0011 | 0.0008 | Invention Example |
| C | | | | | | 0.0012 | | Invention Example |
| D | | | | | | | | Invention Example |
| E | | | 0.09 | | | 0.0009 | 0.0011 | Invention Example |
| F | | | | | | | | Invention Example |
| G | | | | | | | | Invention Example |
| H | | 0.08 | | | | | | Invention Example |
| I | | | | | | | | Invention Example |
| J | | | | 0.03 | 0.0014 | 0.0014 | | Invention Example |
| K | | | | | 0.0009 | | | Invention Example |
| L | 0.03 | | | | 0.0011 | | 0.0009 | Invention Example |
| M | | | | | | | 0.0013 | Invention Example |
| N | | | | | | | | Comparative Example |

TABLE 2

| No. | Steel | Heating temperature (° C.) | Winding temperature (° C.) | Primary cooling rate (° C./s) | Primary cooling time (s) | Retention time (s) | Secondary cooling rate (° C./s) | Secondary cooling end temperature (° C.) | Area fraction of pearlite structure (%) | Average block size (μm) | Standard deviation of block size (μm) |
|---|---|---|---|---|---|---|---|---|---|---|---|
| 1 | A | 1020 | 880 | 45 | 5.6 | 42 | 6 | 290 | 83 | 18 | 9 |
| 2 | B | 1020 | 880 | 45 | 5.6 | 42 | 6 | 290 | 95 | 16 | 8 |
| 3 | B | 1200 | 880 | 11 | 24 | 22 | 7 | 280 | 79 | 36 | 18 |
| 4 | C | 1000 | 850 | 42 | 5.7 | 16 | 9 | 290 | 96 | 26 | 14 |
| 5 | C | 1000 | 860 | 36 | 6.8 | 19 | 9 | 290 | 95 | 35 | 22 |
| 6 | D | 1070 | 840 | 41 | 5.5 | 18 | 9 | 280 | 96 | 21 | 12 |
| 7 | E | 1080 | 880 | 45 | 6.1 | 18 | 9 | 280 | 97 | 23 | 12 |
| 8 | E | 1010 | 880 | 78 | 6.1 | 0 | 9 | 280 | 71 | 13 | 7 |
| 9 | F | 1080 | 870 | 49 | 5.2 | 22 | 6 | 290 | 97 | 21 | 11 |
| 10 | F | 1060 | 900 | 25 | 11 | 16 | 7 | 280 | 97 | 28 | 24 |
| 11 | G | 1070 | 870 | 42 | 6 | 36 | 6 | 290 | 98 | 25 | 13 |
| 12 | H | 1070 | 880 | 49 | 5.4 | 21 | 7 | 290 | 98 | 24 | 12 |
| 13 | H | 1050 | 930 | 31 | 9.5 | 11 | 9 | 290 | 97 | 34 | 17 |
| 14 | I | 1040 | 870 | 45 | 5.5 | 28 | 8 | 280 | 98 | 22 | 13 |
| 15 | I | 1040 | 850 | 20 | 11 | 21 | 8 | 290 | 97 | 31 | 21 |

TABLE 2-continued

| | | | | | | | | | | | |
|---|---|---|---|---|---|---|---|---|---|---|---|
| 16 | J | 1070 | 850 | 50 | 4.7 | 24 | 6 | 290 | 98 | 23 | 12 |
| 17 | K | 1070 | 880 | 51 | 5 | 24 | 9 | 270 | 97 | 25 | 13 |
| 18 | L | 1080 | 840 | 44 | 5.3 | 24 | 9 | 270 | 98 | 23 | 14 |
| 19 | M | 1100 | 850 | 44 | 5.3 | 21 | 24 | 210 | 98 | 24 | 14 |
| 20 | N | 1080 | 870 | 44 | 5.5 | 21 | 24 | 210 | 99 | 22 | 12 |

| No. | Lower limit value of tensile strength 760 × Ceq. + 260 (MPa) | Upper limit value of tensile strength 760 × Ceq. + 325 (MPa) | Tensile strength (MPa) | Lower limit value of reduction of area −65 × Ceq. + 96 (%) | Reduction of area (%) | Standard deviation of reduction of area (%) | Wire-drawing rupture strain | Remarks |
|---|---|---|---|---|---|---|---|---|
| 1 | 820 | 890 | 805 | 47.7 | 55.6 | 3.6 | 3.4 | Comparative Example |
| 2 | 904 | 974 | 954 | 40.5 | 45.7 | 3.7 | 4.2 | Invention Example |
| 3 | 904 | 974 | 891 | 40.5 | 35.4 | 11 | 3.5 | Comparative Example |
| 4 | 866 | 936 | 908 | 43.8 | 47.3 | 3.5 | 4.4 | Invention Example |
| 5 | 866 | 936 | 901 | 43.8 | 40.9 | 7.6 | 3.5 | Comparative Example |
| 6 | 870 | 940 | 913 | 43.4 | 47.2 | 3.6 | 4.2 | Invention Example |
| 7 | 899 | 969 | 941 | 40.9 | 45.6 | 3.9 | 4.4 | Invention Example |
| 8 | 899 | 969 | 1107 | 40.9 | 48.2 | 3.0 | 3.6 | Comparative Example |
| 9 | 941 | 1011 | 983 | 37.3 | 41.5 | 4.1 | 4.3 | Invention Example |
| 10 | 941 | 1011 | 954 | 37.3 | 38.5 | 7.3 | 3.6 | Comparative Example |
| 11 | 974 | 1044 | 1007 | 34.5 | 39.8 | 4.3 | 4.2 | Invention Example |
| 12 | 948 | 1018 | 972 | 36.8 | 40.2 | 3.9 | 4.3 | Invention Example |
| 13 | 948 | 1018 | 959 | 36.8 | 33.5 | 5.4 | 3.4 | Comparative Example |
| 14 | 947 | 1017 | 969 | 36.9 | 42.9 | 4.2 | 4.4 | Invention Example |
| 15 | 947 | 1017 | 951 | 36.9 | 32.1 | 5.5 | 3.3 | Comparative Example |
| 16 | 984 | 1054 | 1010 | 33.7 | 37.5 | 3.7 | 4.3 | Invention Example |
| 17 | 1003 | 1073 | 1024 | 32.1 | 37.0 | 3.6 | 4.1 | Invention Example |
| 18 | 1068 | 1138 | 1078 | 26.5 | 35.4 | 3.7 | 4.0 | Invention Example |
| 19 | 1152 | 1222 | 1169 | 19.3 | 33.6 | 2.9 | 3.9 | Invention Example |
| 20 | 1326 | 1396 | 1302 | 4.4 | 26.3 | 3.2 | 2.7 | Comparative Example |

INDUSTRIAL APPLICABILITY

According to the present invention, a high-carbon steel wire rod with excellent wire drawability and high strength, suitable for uses such as steel cord and sawing wire, can be provided inexpensively with high productivity and good yield. Therefore, the present invention has adequate industrial applicability in wire rod producing industry.

The invention claimed is:

1. A high-carbon steel wire rod with excellent wire drawability, comprising chemical components of, in mass %, C: 0.70% to 1.20%,
Si: 0.10% to 1.2%,
Mn: 0.10% to 1.0%,
P: 0.001% to 0.012%,
S: 0.001% to 0.010%,
N: 0.0010% to 0.0050%, and
the balance: Fe and impurities, wherein in a cross-section perpendicular to a longitudinal direction, an area fraction of pearlite is equal to or more than 95% and equal to or less than 100%, an average block size of the pearlite is 10 μm to 30 nm, and standard deviation of block size is 20 μm or less, and when Ceq. is obtained using formula (1) below, a tensile strength is equal to or more than 760×Ceq.+255 MPa and equal to or less than 760×Ceq.+325 MPa, reduction of area in a tensile test is −65×Ceq.+96(%) or more, and standard deviation of the reduction of area is 6% or less, $$Ceq.=C(\%)+Si(\%)/24+Mn(\%)/6 \quad \text{formula(1)},$$

where C (%), Si (%), and Mn (%) represent contents in mass % of C, S, and Mn, respectively.

2. The high-carbon steel wire rod with excellent wire drawability according to claim 1, further comprising chemical components of, in mass %, one or two or more selected from the group consisting of
Al: 0.0001% to 0.010%,
Ti: 0.001% to 0.010%,
B: 0.0001% to 0.0015%,
Cr: 0.05% to 0.50%,
Ni: 0.05% to 0.50%,
V: 0.01% to 0.20%,
Cu: 0.05% to 0.20%,
Mo: 0.05% to 0.20%,
Nb: 0.01% to 0.10%,
Ca: 0.0005% to 0.0050%,
Mg: 0.0005% to 0.0050%, and
Zr: 0.0005% to 0.010%.

* * * * *